US008196276B2

(12) United States Patent
Sassatelli et al.

(10) Patent No.: US 8,196,276 B2
(45) Date of Patent: Jun. 12, 2012

(54) MULTI-FUNCTIONAL ROTARY TURNING AND POSITIONING APPARATUS AND METHOD

(75) Inventors: John Matthew Sassatelli, Valley Falls, NY (US); Mark Edward Burnett, Barton, NY (US); Engelbert Paauwe, Shorewood, IL (US); Aaron Paauwe, Crestwood, IL (US); Lawrence Michael Grycko, Lockport, IL (US); Jeffrey Paul Cutler, Cohoes, NY (US); Carter Steven Cook, Westford, NY (US)

(73) Assignee: General Electric Company, Schenectady, NY (US)

( * ) Notice: Subject to any disclaimer, the term of this patent is extended or adjusted under 35 U.S.C. 154(b) by 672 days.

(21) Appl. No.: 12/346,208

(22) Filed: Dec. 30, 2008

(65) Prior Publication Data

US 2010/0162544 A1 Jul. 1, 2010

(51) Int. Cl.
*B21D 53/78* (2006.01)

(52) U.S. Cl. ..... 29/23.51; 29/889.1

(58) Field of Classification Search ..... 29/23.51, 29/889.1

See application file for complete search history.

(56) References Cited

U.S. PATENT DOCUMENTS 5,235,745 A 8/1993 Fraser
6,065,344 A * 5/2000 Nolan et al. ..... 73/629
6,115,917 A 9/2000 Nolan et al.

* cited by examiner

*Primary Examiner* — David Bryant
*Assistant Examiner* — Moshe Wilensky
(74) *Attorney, Agent, or Firm* — Ernest G. Cusick; Gary M. Hartman; Domenica N. S. Hartman

(57) ABSTRACT

A multi-functional rotary turning and positioning apparatus and method for performing multiple service operations on a turbomachinery rotor while the rotor remains continuously supported with the apparatus. The apparatus includes a platform, a rotary headstock mounted to the platform, a spindle coupled to and rotatably supported by the headstock and adapted for coupling to a turbomachinery rotor, bearing pedestals mounted to the platform and adapted for rotatably supporting the rotor, at least one motor for turning the spindle at least two different rotational speed ranges, equipment mountable to the platform for performing multiple service operations on the rotor, and equipment for controlling the rotational speed and position of the spindle for the purpose of performing the service operation with the operating equipment.

20 Claims, 2 Drawing Sheets

MULTI-FUNCTIONAL ROTARY TURNING AND POSITIONING APPARATUS AND METHOD

BACKGROUND OF THE INVENTION

The present invention generally relates to turbomachinery rotors, and more particularly to an apparatus configured to enable multiple service operations to be performed on a turbine rotor while the rotor remains continuously supported with the apparatus.

Depending on design considerations and their operating conditions, turbomachinery rotors used in steam turbines, gas turbines, and jet engines may have assembled or monolithic constructions. For example, large steam turbines typically have a bolted construction made up of separate rotors, each having a shaft with an integrally-formed wheel. Rotors for gas turbines and jet engines are often constructed by bolting a series of disks and shafts together. Another rotor construction involves welding together rotor segments formed of dissimilar materials, forming what may be termed a multiple alloy rotor (MAR). Monolithic multiple alloy rotors have also been proposed. In each case, the rim of the wheel (disk) is configured for mounting buckets (blades). A conventional mounting technique is to form slots having dovetail cross-sections configured to interlock with complementary dovetail features on the root portions of the buckets.

Turbine rotors operate at high rotational speeds in a thermally-hostile environment. Though significant advancements have been made in alloys to achieve long service lives, wear, erosion, corrosion, shock, fatigue and/or overstress inevitably occur, necessitating periodic inspection and, if necessary, repair or replacement of a rotor or its components. The dovetail region of a wheel is particularly susceptible to cracking as a result of the rim being subjected to higher stresses. Inspection and servicing of large steam turbine rotors and their components typically entail removing the rotor from the steam turbine and transporting the rotor to a service center, incurring cost and cycle time. At the service center, the rotor is mounted on a lathe or a similar lathe-type apparatus adapted to rotate the rotor about its axis. The rotor is typically supported along its length with pedestals that help support the weight of the rotor without interfering with its ability to rotate. The rotor then undergoes the desired service operation, which may include cleaning, dimensional inspection, nondestructive examination (NDE), disassembly/assembly, machining, welding, stress relief, or balancing. These operations typically involve incrementally rotating the rotor to remove the buckets, incrementally or slowly rotating the rotor to remove damaged dovetail regions, perform a welding operation to build up material on the machined surfaces, stress relieve the weld buildup, and machine the weld buildup to reform the dovetail regions, and finally rotating the rotor at a speed sufficiently high to determine rotor alignment, from which balance weights can be added to the rotor to ensure that the rotor is balanced for rotation about its axis.

Because of the different capabilities required for a given service operation, separate workstations are typically used to perform the various operations, for example, a lathe, mill, weld positioner, low-speed balance pit, etc., to perform the necessary operations. Each transfer between workstations requires breaking the previous setup, performing a new setup, and transporting the rotor between workstations by crane, train, tractor trailer, crawler, etc. It is not uncommon for a rotor to sit in a queue waiting for a nondedicated tool or workstation to be available to perform the next operation on the rotor.

From the above, it can be appreciated that the use of dedicated rotor workstations incurs considerable cycle time and cost. Drawbacks of the conventional service approach have been addressed in part by establishing workstations dedicated to multiple operations, such as machining and welding, to reduce setup times, establish a more continuous flow through the process, and eliminate some queues in the system. However, such workstations have not been adapted to perform operations at which widely different rotational speeds are required, for example, when performing a dynamic balancing operation. Such workstations have also not typically lent themselves to installations outside of a service shop, and the service process still requires movement of a rotor through multiple process steps.

BRIEF DESCRIPTION OF THE INVENTION

The present invention provides a multi-functional rotary turning and positioning apparatus suitable for enabling multiple service operations to be performed on a turbomachinery rotor while the rotor remains continuously supported with the apparatus.

According to a first aspect of the invention, the apparatus includes a platform, a rotary headstock mounted to the platform, a spindle coupled to and rotatably supported by the headstock and adapted for coupling to a turbomachinery rotor, bearing pedestals mounted to the platform and adapted for rotatably supporting the rotor, at least one motor means for turning the spindle at at least two different rotational speed ranges, operating means mountable to the platform for performing multiple service operations on the rotor, and means for controlling the rotational speed and position of the spindle for the purpose of performing the service operation with the operating means.

According to a second aspect of the invention, a method of performing multiple service operations on a turbomachinery rotor includes providing a platform on which are mounted a rotary headstock and bearing pedestals, rotatably supporting a turbomachinery rotor on the bearing pedestals and coupling the rotor to a spindle coupled to and rotatably supported by the headstock, turning the spindle at a first rotational speed, and performing a first service operation on the rotor with a first operating means while controlling the rotational speed and position of the rotor. Then, and without uncoupling the rotor from the spindle and without removing the rotor from the bearing pedestals, the spindle is turned at a second rotational speed different from the first rotational speed, and a second service operation is performed on the rotor with a second operating means while controlling the rotational speed and position of the rotor. The rotor can then be uncoupled from the spindle and removed from the bearing pedestals.

In view of the above, it can be seen that a significant advantage of this invention is a portable apparatus that enables a single setup for performing multiple service operations, such as machining, welding, and dynamic balancing of a turbomachinery rotor, as well as potentially other operations, such as cleaning, dimensional inspection, nondestructive examination (NDE), disassembly/assembly, etc. The apparatus is preferably portable and capable of eliminating the need to remove a rotor from its installation site, transport, lift or otherwise handle the rotor for movement between multiple workstations, and change the rotor fixturing setup. As a result, total cycle, labor input and cost can be significantly reduced and the risk of concentricity issues is reduced by performing a single setup. Particular operations performed on the rotor, including machining, welding, stress-relieving and dynamic balancing, can be numerically controlled.

Other aspects and advantages of this invention will be better appreciated from the following detailed description.

DETAILED DESCRIPTION OF THE INVENTION

Figure 1:
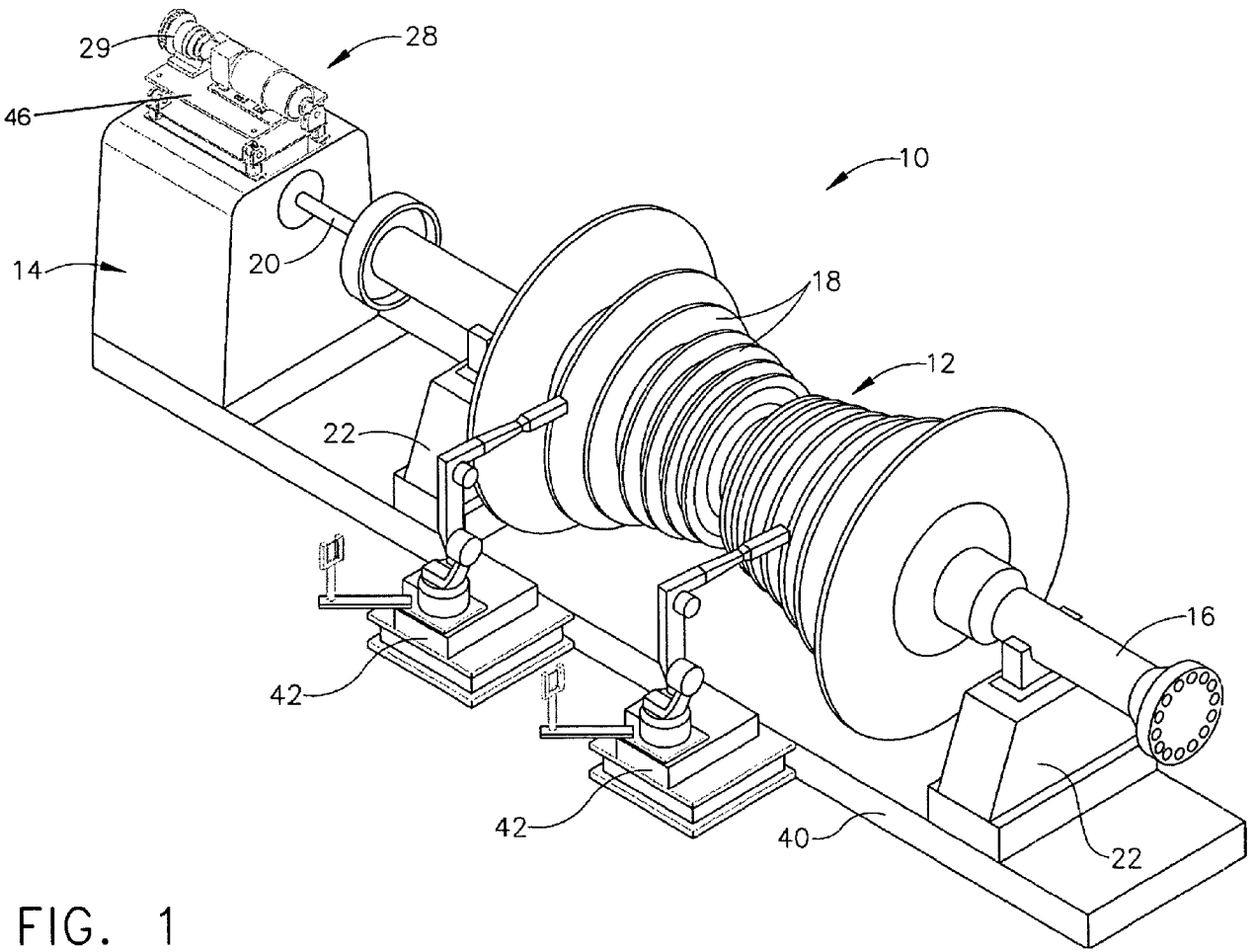
FIG. 1 is a perspective view of a portable multi-functional rotary turning and positioning apparatus in accordance with an embodiment of this invention.

FIG. 1 illustrates a portable rotary turning and positioning apparatus 10 capable of positioning and rotating a turbomachinery rotor 12 at variable speeds for the purpose of performing multiple service operations, including but not limited to lathe turning, milling, welding, and low-speed dynamic balancing. The rotor 12 is represented as a steam turbine rotor, though it should be understood that the invention is not limited to any particular type of rotor or rotor construction. The shaft 16 of the rotor 12 is shown in FIG. 1 as coupled to a spindle 20 extending from a headstock enclosure 14. The apparatus 10 further includes bearing pedestals 22 for supporting the rotor 12 along its axial length. The apparatus 10 preferably has a load capacity sufficient for very large rotors, for example, up to about 140 tons (about 127 metric tons).

Figure 2:
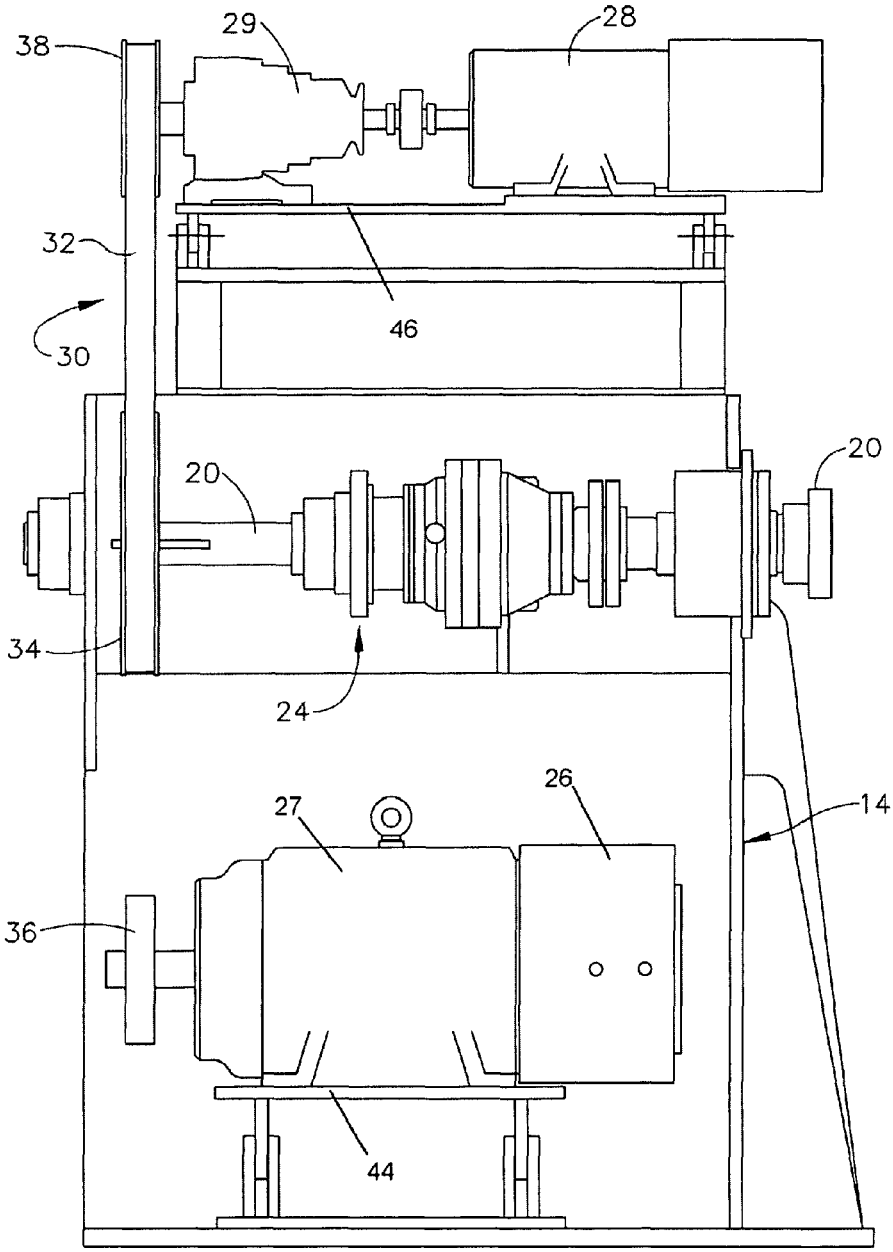
FIG. 2 represents a cross-sectional view of a headstock enclosure of the apparatus of FIG. 1.

The headstock enclosure 14 is shown in FIG. 2 as including a headstock 24 that supports the spindle 20, and a motor 26 and gearbox 27 for rotating the rotor 12 at relative high speeds. In part, the motor 26 is chosen based on the desired capability to both continuously and intermittently rotate the rotor 12 at speeds for performing operations such as machining, stress relief, dynamic balancing, etc., necessitating a high torque capability. The output speed capability of the motor 26 may be, for example, a motor armature speed of up to about 1750 rpm, and a suitable power output for the motor 26 is about 200 horsepower (about 150 kW), though it is foreseeable that motors with speed and power outputs outside of these ranges could also be used. A preferred motor 26 also has a stall torque capability of about 500 ft-lbf (about 680 J). Motors with these operating capabilities include electric motors currently used in the industry for this purpose, and therefore will not be discussed in further detail.

To cover a lower range of speeds required to perform, for example, nondestructive examination, welding, etc., on the rotor 12, a second motor 28 and gearbox 29 are shown mounted on the enclosure 14 and, with the first motor 26, are adapted to be selectively engaged with the headstock 24 through a drive system 30. Similar to the motor 26, the motor armature speed of the motor 28 may be, for example, up to about 1750 rpm. A suitable power output for the motor 28 is about 30 horsepower (about 20 kW), though it is foreseeable that motors with speeds and power outside of these ranges could also be use. The motor 28 also preferably has a stall torque capability of about 100 ft-lbf (about 140 J). Motors with these operating capabilities include electric motors currently used in the industry for this purpose, and therefore will not be discussed in further detail.

FIG. 2 represents the drive system 30 as including a toothed drive belt 32, a pulley 34 mounted on the spindle 20 opposite the rotor 12, and pulleys 36 and 38 mounted on the motors 26 and 28, respectively. Tensioning of the belt 32 is preferably achieved by mounting the motors 26 and 28 on hinged platforms 44 and 46 that allow changing the center-to-center distances on the pulleys 36 and 38 individually, and set the correct belt tension. The platforms 44 and 46 may be actuated with, for example, hydraulics to raise the motors 26 and 28, and then held in position with, for example, screw jacks. Other means for transferring power between the motors 26 and 28 to the spindle 20 are also within the scope of the invention.

Taking into account the armature speeds of the motors 26 and 28, the gearboxes 27 and 29 and drive system 30 are chosen to achieve a lower range of rotor speeds of about 0.01 to about 2.0 rpm with the motor 28, and a higher range of rotor speeds of about 2.0 rpm or more with the motor 26. For example, the gearbox 27 coupled to the motor 26 may have a gear ratio of, for example, about 13:1, to achieve relatively high speed outputs to the spindle 20 of up to about 140 rpm, and the gearbox 29 coupled to the motor 28 may have a much higher gear ratio of, for example, about 900:1, to achieve lower speed outputs to the spindle 20 of up to about 2 rpm. Those skilled in the art will appreciate that, instead of two separate motors 26 and 28, the two-speed-range capability desired by this invention could be achieved with a single motor/gearbox drive line, and such embodiments are within the scope of this invention.

In order to provide both precise speed and position control of the rotor 12, the apparatus 10 preferably includes a computer numeric control (CNC) unit (not shown) coupled to velocity and position transducers (not shown) on the motors 26 and 28, spindle 20 and/or rotor 12, and the equipment performing the particular operation on the rotor 12. According to standard practice, encoder feedback of motor speeds can be handled by the individual motors 26 and 28, as supplied by the motor manufacturer.

FIG. 1 represents robotic welding units 42 positioned alongside the rotor 12, by which a welding operation can be performed on the rotor 12, for example, on a wheel 18 of the rotor 12. In addition to the welding units 42, the apparatus 10 is adapted to accommodate a variety of other equipment capable of performing desired operations on the rotor 12, particularly tool holders for performing machining operations (e.g., turning), a balance computer, spindle speed pickup, and accelerometers placed on the pedestals 22 for performing dynamic balancing operations, as well as equipment for performing cleaning, dimensional inspection, nondestructive examination (NDE), disassembly/assembly, and/or stress relief. Such equipment can be of conventional types known in the art or otherwise within the capabilities of those skilled in the art. However, in each case the equipment preferably utilize speed and/or position transducers by which the speed and angular position of the rotor 12 can be controlled with the motors 26 and 28.

The bearing pedestals 22 and their low-friction bearings that contact the rotor 12 must be capable of supporting the rotor 12 during relative low-speed machining and welding operations, as well as higher speeds required for dynamic rotor balancing operations. For this purpose, the bearing pedestals 22 may utilize hydrostatic bearings, though other types of bearing could be used, including rollers and hydrodynamic bearings disclosed in co-pending U.S. Pat. No. 7,946,544. Otherwise, design aspects for the bearing pedestals 22 are generally known in the art or otherwise within the capabilities of those skilled in the art.

The enclosure 14, bearing pedestals 22, and welding units 42 are shown in FIG. 1 as being supported on a platform 40. The platform 40 is preferably configured to provide the capability of transporting the apparatus 10 as a unit between installation, service facilities, and other locations where there may be a need to inspect and/or repair a turbomachinery rotor.

The platform 40 preferably has the capacity to support the remaining components as a lifting beam, as well as provides points to tie down the apparatus 10 to a trailer for transport.

In use, once the rotor 12 is set into place on the apparatus 10, an operator simply arranges the drive system 30 to select the appropriate motor 26 or 28 to achieve a speed range appropriate for the particular operation to be performed. For example, typical NDE, turning, welding, and post-weld heat treatment operations can be performed at continuous rotational speeds of, respectively, about 0.25 to about 2 rpm, about 5 to about 20 rpm, about 0.01 to about 0.1 rpm, and about 4 to about 10 rpm. Without removing the rotor 12 from the apparatus 10, a dynamic balancing operation can be subsequently performed at rotational speeds of about 100 to about 150 rpm. A precise rotational speed for the rotor 12 (and therefore a precise surface speed on any surface of the rotor 12) can be set, monitored and computer controlled through the speed transducers. The angular position of the rotor 12 can also be monitored and controlled through the same CNC unit using position transducers, thus enabling a fully-integrated numerically-controlled apparatus 10 capable of performing lathe (e.g., turning), milling, welding, and balancing operations with a single setup. This capability facilitates the portability of the apparatus 10 and significantly reduces setup and total cycle time.

While the invention has been described in terms of a preferred embodiment, it is apparent that other forms could be adopted by one skilled in the art. For example, the physical configuration of the apparatus 10 could differ from that shown. Therefore, the scope of the invention is to be limited only by the following claims.

The invention claimed is:

1. A multi-functional rotary turning and positioning apparatus for performing multiple service operations on a turbomachinery rotor while the rotor remains continuously supported with the apparatus, the apparatus comprising:

a platform;

a rotary headstock mounted to the platform;

a spindle coupled to and rotatably supported by the headstock and adapted for coupling to a turbomachinery rotor;

bearing pedestals mounted to the platform and adapted for rotatably supporting the rotor;

at least one motor means for turning the spindle at least two different rotational output speed ranges, wherein the at least one motor means comprises at least two motors coupled with gearboxes to provide the different rotational output speed ranges;

operating means mountable to the platform for performing multiple service operations on the rotor; and means for controlling the rotational speed and angular position of the spindle for the purpose of performing the service operation with the operating means.

2. The multi-functional rotary turning and positioning apparatus according to claim 1, wherein the operating means comprise at least two equipment chosen from the group consisting of dimensional inspection, nondestructive examination, disassembly/assembly, machining, welding, stress-relieving, and dynamic balancing equipment.

3. The multi-functional rotary turning and positioning apparatus according to claim 1, wherein a first of the at least two different rotational output speed ranges is a rotational output speed range of about 0.01 to about 2.0 rpm, and a second of the at least two different rotational output speed ranges is a rotational output speed range of about 2.0 rpm and greater.

4. The multi-functional rotary turning and positioning apparatus according to claim 1, wherein the platform is transportable while the headstock, the spindle, the bearing pedestals, the at least one motor means, and the operating means remain mounted thereon.

5. The multi-functional rotary turning and positioning apparatus according to claim 1, wherein the at least two motors are coupled with, respectively, at least two gearboxes to provide the different rotational output speed ranges.

6. The multi-functional rotary turning and positioning apparatus according to claim 5, wherein a first of the motors and a first of the gearboxes coupled thereto are operable to turn the spindle at a rotational output speed range of about 0.01 to about 2.0 rpm.

7. The multi-functional rotary turning and positioning apparatus according to claim 6, wherein a second of the motors and a second of the gearboxes coupled thereto are operable to turn the spindle at a rotational output speed range of about 2.0 rpm and greater.

8. The multi-functional rotary turning and positioning apparatus according to claim 5, wherein the motors have different rotational output torque levels.

9. The multi-functional rotary turning and positioning apparatus according to claim 5, further comprising drive means for selectively coupling one of the motors to the spindle at any given time.

10. The multi-functional rotary turning and positioning apparatus according to claim 9, wherein the drive means comprises pulleys coupled to the motors and to the spindle, and means for selectively rotationally coupling the pulley of the spindle to the pulleys of the motors.

11. The multi-functional rotary turning and positioning apparatus according to claim 1, wherein the means for controlling the rotational speed and angular position of the spindle comprises a numeric control unit and transducers that provide speed and angular position feedback from the spindle to the numeric control unit.

12. The multi-functional rotary turning and positioning apparatus according to claim 11, wherein the numeric control unit controls the at least one motor means and the operating means.

13. A multi-functional rotary turning and positioning apparatus for performing multiple service operations on a turbomachinery rotor while the rotor remains continuously supported with an apparatus, the apparatus comprising:

a platform;

a rotary headstock mounted to the platform;

a spindle coupled to and rotatably supported by the headstock and adapted for coupling to a turbomachinery rotor;

bearing pedestals mounted to the platform and adapted for rotatably supporting the rotor;

motor means and at least two gearboxes with which the motor means is coupled to selectively turn the spindle at least two different rotational output speed ranges associated with the at least two gearboxes, respectively;

operating means mountable to the platform for performing multiple service operations on the rotor; and means for controlling the rotational speed and angular position of the spindle for the purpose of performing the service operation with the operating means.

14. The multi-functional rotary turning and positioning apparatus according to claim 13, wherein the operating means comprise at least two equipment chosen from the group consisting of dimensional inspection, nondestructive examination, disassembly, assembly, machining, welding, stress-relieving, and dynamic balancing equipment.

15. The multi-functional rotary turning and positioning apparatus according to claim 13, wherein a first of the at least two different rotational output speed ranges is a rotational output speed range of about 0.01 to about 2.0 rpm, and a second of the at least two different rotational output speed ranges is a rotational output speed range of about 2.0 rpm and greater.

16. The multi-functional rotary turning and positioning apparatus according to claim 13, wherein the platform is transportable while the headstock, the spindle, the bearing pedestals, the motors, and the operating means remain mounted thereon.

17. The multi-functional rotary turning and positioning apparatus according to claim 13, wherein the motor means comprises a first motor coupled to a first of the at least two gearboxes, and the first motor and the first gearbox coupled thereto are operable to turn the spindle at a rotational output speed range of about 0.01 to about 2.0.

18. The multi-functional rotary turning and positioning apparatus according to claim 17, wherein the motor means comprises a second motor coupled to a second of the at least two gearboxes, and the second motor and the second gearbox coupled thereto are operable to turn the spindle at a rotational output speed range of about 2.0 rpm and greater.

19. The multi-functional rotary turning and positioning apparatus according to claim 18, wherein the motors have different rotational output torque levels.

20. The multi-functional rotary turning and positioning apparatus according to claim 18, further comprising drive means for selectively coupling one of the motors to the spindle at any given time.

* * * * *

UNITED STATES PATENT AND TRADEMARK OFFICE

CERTIFICATE OF CORRECTION

PATENT NO. : 8,196,276 B2
APPLICATION NO. : 12/346208
DATED : June 12, 2012
INVENTOR(S) : Sassatelli et al.

It is certified that error appears in the above-identified patent and that said Letters Patent is hereby corrected as shown below:

On the Title Page, in Field (57), under "ABSTRACT", in Column 2, Line 10, delete "at" and insert -- at at --, therefor.

In Column 5, Line 45, in Claim 1, delete "spindle at" and insert -- spindle at at --, therefor.

In Column 6, Line 54, in Claim 13, delete "at" and insert -- at at --, therefor.

Signed and Sealed this
Thirteenth Day of November, 2012

David J. Kappos

David J. Kappos
*Director of the United States Patent and Trademark Office*